United States Patent [19]

Haines et al.

[11] 4,105,532

[45] Aug. 8, 1978

[54] IMPROVEMENTS IN OR RELATING TO THE ELECTROWINNING OF METALS

[75] Inventors: Kendrick Peter Haines, Havant, England; Roy Duncan MacPherson, Luxembourg, Luxembourg

[73] Assignee: Parel Societe Anonyme, Luxembourg, Luxembourg

[21] Appl. No.: 647,636

[22] Filed: Jan. 8, 1976

[30] Foreign Application Priority Data

Jan. 9, 1975 [GB] United Kingdom ..... 1014/75

[51] Int. Cl.[2] ..... C25C 1/06; C25C 1/08; C25C 7/00; C25C 7/04

[52] U.S. Cl. ..... 204/301; 204/48; 204/112; 204/180 P

[58] Field of Search ..... 204/130, 112, 149, 180 P, 204/301, 48

[56] References Cited

U.S. PATENT DOCUMENTS

| | | | |
|---|---|---|---|
| 2,723,229 | 11/1955 | Bodamer | 204/180 P X |
| 2,739,934 | 3/1956 | Kunin | 204/180 P X |
| 3,231,485 | 1/1966 | Kuwata et al. | 204/180 P |
| 3,330,749 | 7/1967 | Kuwata et al. | 204/180 P |
| 3,553,092 | 1/1971 | Mund et al. | 204/180 P |
| 3,716,459 | 2/1973 | Salter et al. | 204/1 R |
| 3,755,114 | 8/1973 | Tartanyi et al. | 204/114 |
| 3,964,985 | 6/1976 | Giuffrida | 204/180 P |

OTHER PUBLICATIONS

Wilson, "Demineralization by Electrodialysis", (1960), pp. 43 & 44.

*Primary Examiner*—Arthur C. Prescott
*Attorney, Agent, or Firm*—Armstrong, Nikaido, Marmelstein & Kubovcik

[57] ABSTRACT

An electrolytic cell and process are described for use in a plant for the cathodic recovery of a metal from, for example, an ore. The cell includes one or more intermediate compartments which are bounded by ion-permeable separators and are disposed between the anode compartment and the cathode compartment. In the process, an aqueous solution of a salt of the metal is circulated around a first circuit including the cathode compartment of the cell, and an acid solution is circulated around a second circuit including the anode compartment. The fluid in the intermediate compartment(s) may also be circulated.

6 Claims, 3 Drawing Figures

IMPROVEMENTS IN OR RELATING TO THE ELECTROWINNING OF METALS

BACKGROUND OF THE INVENTION

This invention relates to processes and plants for the electrodeposition of metals and, more particularly but not exclusively, is concerned with the extraction and recovery of cobalt and other metals from their ores.

There are known to us extraction and recovery processes which involve the leaching of cobalt into solution followed by purification of the cobalt-rich solution and precipitation of cobalt as one of its salts or oxides. In one such process, the cobalt is precipitated as its basic oxide, and the precipitate is dissolved in an electrolyte of a cobalt electrowinning circuit at a rate sufficient to replace the cobalt removed from the electrolyte during the electrowinning process (this operation frequently being referred to as "the re-solution stage"). The coulombic efficiency of cobalt electrodeposition at the cathode of an electrolytic cell is greatly influenced by the concentration of acid present in the cobalt electrolyte and, in conventional electrowinning processes, falls with increasing concentration of acid. In existing processes only about 5 gpl (gms per liter) cobalt can usually be removed efficiently from solution per pass through the electrowinning cell because the electrodeposition of cobalt releases acid into the solution which adversely affects the coulombic efficiency. Electrowinning is frequently carried out from solutions containing about 40 gpl cobalt and it is readily seen that the small "delta cobalt", i.e. the small concentration change, in the electrowinning stage, inherent in the above process gives rise to a high recycling load of cobalt in the solution and high flow rates through the plant. There must be acid present in the electrolyte at the re-solution stage for there to be dissolution of the basic cobalt oxide. However, it is not feasible to retain in the electrolyte the acid generated in the cell while operating with a high "delta cobalt" in the electrolyte, i.e. a large concentration change, in the electrowinning process.

Typical examples of the processes outlined above are described in "World Mining", September 1970, pages 42–47.

It has also been proposed to precipitate the cobalt as its sulphate and in such a process the feed precipitate cannot neutralise the acid and it is therefore essential that the acid generated in the electrowinning cell be removed from the electrowinning circuit.

Although the above description relates exclusively to the electrowinning of cobalt, it will be apparent that similar considerations apply to the extraction and recovery of a number of other metals, for example nickel and zinc, by the known electrowinning processes.

Our copending British Patent Application No. 31524/74 describes and claims an electrolytic process, for the electrodeposition of a metal from an aqueous solution of a salt of said metal, which process comprises the steps of disposing between the anode and cathode of an electrochemical cell a separator which incorporates an anion exchange membrane which is substantially impermeable to cations, so as to form separate anode and cathode compartments within said cell, establishing within said cathode compartment a particulate cathode, flowing said aqueous solution into said cathode compartment, imposing a potential difference across the anode and cathode of said cell sufficient to electrodeposit metal from said aqueous solution of a salt of said metal on to the particulate cathode, and allowing passage of anions through said anion exchange membrane. The said patent application also describes and claims in electrochemical cell, suitable for use in the electrodeposition of metal from an aqueous solution of a salt of said metal, wherein the cell is provided with a separator which is disposed between the cathode and anode of the electrochemical cell so as to form separate anode and cathode compartments within said cell and which incorporates an anion exchange membrane, and wherein the cathode compartment contains a particulate cathode.

The electrolytic process and electrochemical cell described and claimed in the above mentioned patent application enable the electrowinning of cobalt to take place without a number of disadvantages associated with conventional cobalt electrowinning practice. For example, cobalt is conventionally deposited on stainless steel "blank" cathodes. After the deposit has grown to an acceptable thickness it is stripped from these blank cathodes. The removal of the deposit from the blanks can be an arduous process because in some cases the cobalt metal adheres strongly to the stainless steel blank. The removal of deposited cobalt from the blank is usually carried out manually using hammers or chisels. This can lead to damage of the blanks. These problems are obviated by the electrolytic process and electrochemical cell described and claimed in the said patent application. Nevertheless, problems associated with the production of acid during the electrolytic process are not entirely overcome by our earlier process and cell. Accordingly, it is an object of the present invention to provide an electrolytic process and electrolytic cell in which the problems associated with the production of acid during the electrowinning of, inter alia, cobalt are ameliorated.

SUMMARY OF THE INVENTION

We have now devised an electrolytic cell and process whereby the deleterious effects of acid production during the operation of the electrolytic process can be ameliorated. More particularly, according to one aspect of the present invention there is provided, in a plant for the recovery of a metal from an ore, concentrate, matte or alloy at a cathode of an electrolytic cell in an electrowinning circuit of said plant, the improvement which comprises constructing said electrolytic cell so that it has an anode compartment including or adapted to receive an anode, a cathode compartment including or adapted to receive a cathode, and at least one intermediate compartment interposed between the anode compartment and the cathode compartment, the bounderies between the anode compartment and the or its contiguous intermediate compartment; between adjacent intermediate compartments, if present; and between the cathode compartment and the or its contiguous intermediate compartment, each including a separator which is permeable to at least one of the ionic species which, during operation of said cell, is present in the or one of the intermediate compartment(s) bounded by the respective separator.

According to another aspect of the present invention there is provided, in the electrowinning stage of a process for the recovery of a metal from an ore, matte, concentrate or alloy wherein in said electrowinning stage said metal is electrodeposited at the cathode of an electrolytic cell from an aqueous solution of at least one salt of the metal, the electrolytic cell having an anode compartment including an anode, a cathode compartment including a cathode, and at least one intermediate compartment interposed between the anode compartment and the cathode compartment, the boundaries between the anode compartment and the or its contiguous intermediate compartment; between adjacent intermediate compartments, if present; and between the cathode compartment and the or its contiguous intermediate compartment, each including a separator which is permeable to at least one of the ionic species present in the or one of the intermediate compartment(s) during the electrowinning stage, that separator which is contiguous with the cathode compartment being permeable to anions, the steps of:

(a) circulating said aqueous solution around a first circuit including the cathode compartment;
(b) circulating an acid solution around a second circuit including the anode compartment; and
(c) imposing a potential difference across the electrodes of the cell sufficient to electrodeposit metal at the cathode.

Depending on the nature of the process, the separator contiguous with the cathode compartment may be fluid permeable; ion permeable but generally fluid impermeable, or selectively anion permeable.

By provision of one or more intermediate compartments interposed between the anode compartment and the cathode compartment, it is possible to promote the reduction of concentration of acid in the electrolyte during the electrowinning of, for example, cobalt from a sulphate solution. We have found that an unexpected increase in coulombic efficiency of the process can thereby be achieved.

DESCRIPTION OF THE PREFERRED EMBODIMENTS

Advantageously, the cathode of the electrolytic cell employed in the plant and process of the invention is formed as a particulate electrode, i.e. an electrode comprising a plurality of discrete electroconductive particles which, when the electrode is in use, are caused to move so as to make contact with a solid current feeder, by means of which an electric current is conducted to the particles. The use of such a particulate cathode can result in improvements in the properties of the layers of electrodeposited metal together with a large increase in the operating current density across the cell as compared with the current density available with processes and plants employing planar or other non-particulate cathodes.

In one embodiment of the invention there is employed a cell having two separators defining the boundaries between a single intermediate compartment and the anode compartment on the one hand and the cathode compartment on the other hand, each of which incorporates an anion-exchange membrane. This embodiment has application, for example, to the electrowinning of cobalt from a cobalt sulphate feed precipitate. Solutions having different compositions are circulated through each of the three compartments of the cell. Thus, through the cathode compartment is passed an aqueous solution bearing ions of the metal to be electrodeposited, typically at a concentration of around 60 gpl cobalt. Through the intermediate compartment is passed a dilute acid solution and through the anode compartment is passed a more concentrated acid solution. As acid is generated in the anode compartment it is drawn off from the circuit which includes the anode compartment, and water to make up the anolyte may be added directly to this circuit or via the circuit including the intermediate compartment in which case dilute acid from the intermediate compartment is supplied to the circuit including the anode compartment.

In a second embodiment of the invention, a cell having a separator including an anion-exchange membrane contiguous with the cathode compartment and a separator including a cation-exchange membrane contiguous with the anode compartment is employed. In this process dilute acid is generated in the intermediate compartment. This embodiment of the invention has particular application, for example, in the electrowinning of cobalt from solutions made up from basic cobalt oxide precipitates. As has been explained above, the dissolution of cobalt oxide into the solution requires an acid solution. Accordingly, spent catholyte is circulated through the intermediate compartment and the acid generated in the intermediate compartment is picked up by the spent catholyte prior to its contact with fresh cobalt oxide precipitate which results in neutralisation of the acid and dissolution of the cobalt oxide.

For a better understanding of the invention, and to show more clearly how the same may be carried into effect, reference will now be made, by way of example, to the accompanying drawings, in which.

Figure 1:
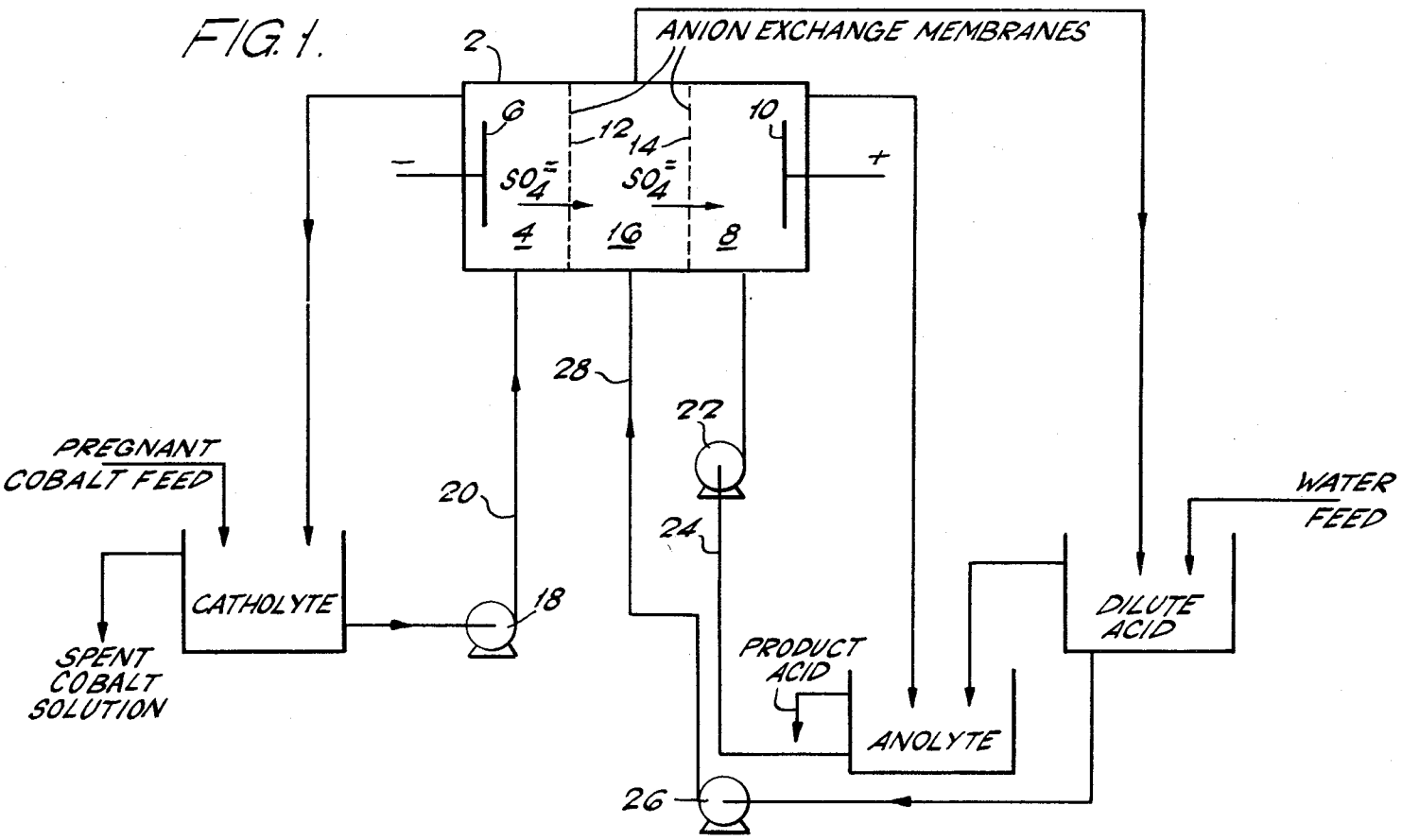
FIG. 1 shows a schematic flowsheet of an electrowinning plant and process employing an electrolytic cell having a single intermediate compartment bounded by two separators each including an anion-exchange membrane.

In FIG. 1 there is shown an electrowinning plant and process which employs a three compartment cell 2. In addition to an anode compartment 8 which contains an anode 10, and a cathode compartment 4 which contains a cathode 6, the cell has an intermediate compartment 16 defined by separators 12 and 14 which separate the intermediate compartment from the cathode compartment and anode compartment respectively and each of which includes an anion-permeable diaphragm. Catholyte is fed to the cathode compartment 4 and around a circuit 20 by a pump 18. Anolyte comprising an acid solution is fed to the anode compartment 8 and around a circuit 24 by a pump 22. A solution comprising a dilute acid is fed to the intermediate compartment 16 and around a circuit 28 by a pump 26. In the electrowinning process, acid produced in the anode compartment (at a concentration of, for example, 150 gpl) is withdrawn from the circuit 24 and is replenished with dilute acid from the circuit 28. The circuit 28 is itself replenished with water. The acid product can be used in a leaching step of the overall electrowinning process.

Figure 2:
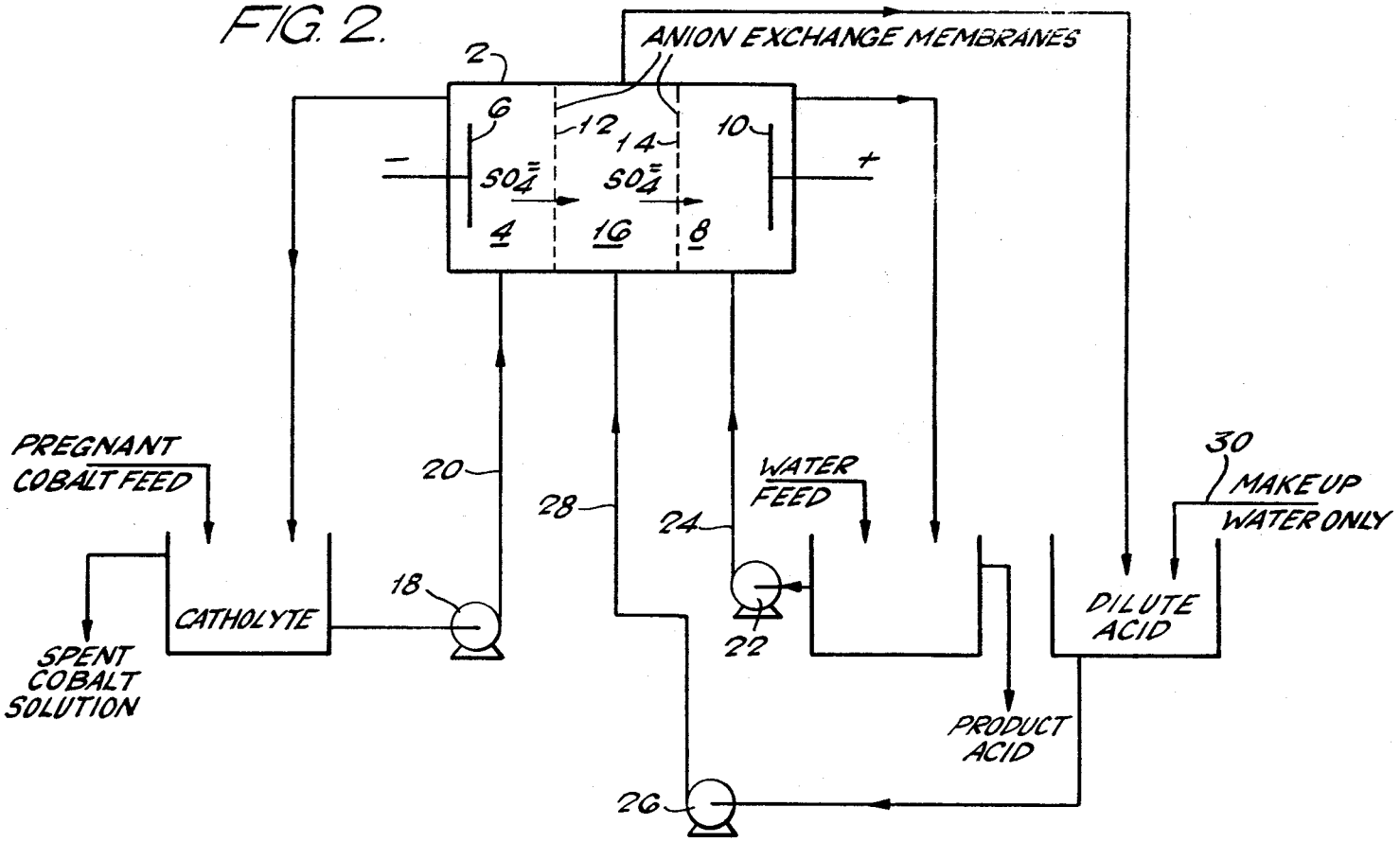
FIG. 2 shows a schematic flowsheet of an electrowinning plant and process similar to that shown in FIG. 1.

The process shown in FIG. 2 differs only slightly from that of FIG. 1. In the process of FIG. 2, the circuit 28 is closed and replenishment of circuit 24 when acid is withdrawn therefrom is made directly with water to the circuit 24. It may be necessary to maintain the quantity of fluid in the circuit 28 against miscellaneous losses such as evaporation and leaks in the circuit and such maintenance can be provided by water from a make up supply 30.

Figure 3:
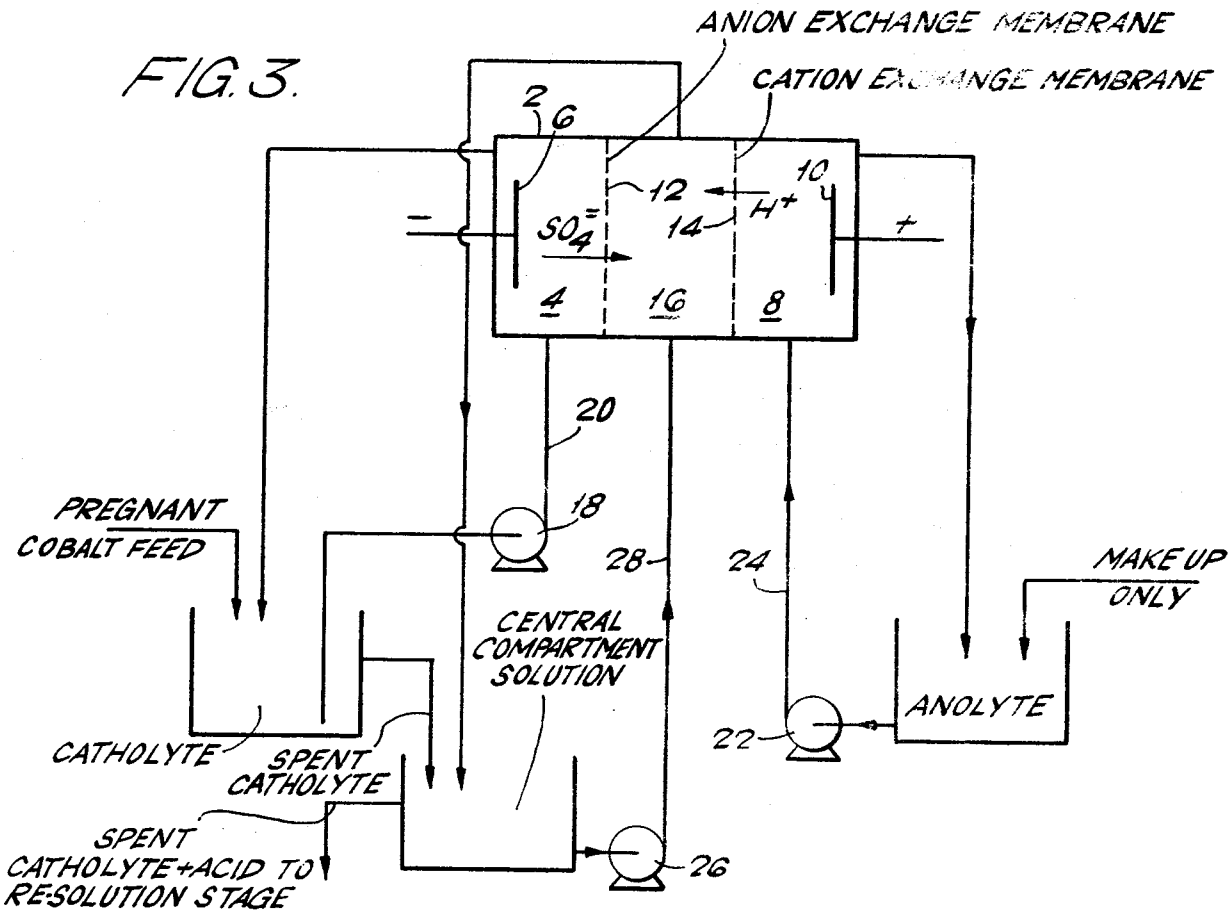
FIG. 3 shows an electrowinning plant and process employing an electrolytic cell having a single intermediate compartment bounded by one separator including an anion exchange membrane and one separator including a cation exchange membrane.

In FIG. 3, the process shown has particular application to the electrowinning of cobalt from basic cobalt oxides and will be described below in terms of such a process. A three-compartment cell 2 has a separator 12 including an anion exchange membrane separating a cathode compartment 4 and an intermediate compartment 16, and a separator 14 including a cation-exchange membrane separating the intermediate compartment and an anode compartment 8. During the process, sulphate ions forming in the cathode compartment 4 migrate through the anion-exchange membrane included in the separator 12 as cobalt ions are removed from the catholyte at the cathode, and the catholyte pH therefore only falls slightly as the catholyte passes through the cathode compartment 4. However, dilute acid is formed in the intermediate compartment 16 and is picked up by the spent catholyte prior to its contact with basic cobalt oxide for re-solution. The acid in the spent catholyte and the basic cobalt oxide neutralise one another as the cobalt is taken into solution, so that a relatively acid-free solution is fed to the cathode compartment 4. This "acid-free" catholyte passes through the cathode compartment and then through the intermediate compartment in circuit 28.

The process provides for the inclusion of the acid generated during electrolysis in the catholyte passing to the re-solution stage but at the same time provides that most of the acid is excluded from the cathode compartment of the cell, so allowing more electrodeposition of cobalt per pass through the cell while maintaining a high coulombic efficiency.

The separator 12 including an anion-exchange membrane may be replaced by a separator including a microporous diaphragm so that there is a bulk flow of catholyte, amounting to a small fraction of the total flow of catholyte through the cathode compartment, through the diaphragm. One such arrangement might involve a diaphragm comparable to the "cathode bag" conventionally used in nickel electrowinning.

The invention is further illustrated by the following Examples.

EXAMPLE 1

A cell as shown in FIG. 1, having a particulate cathode, was operated in a manner similar to that described above with reference to FIG. 1. As indicated in FIG. 1, the flow of anolyte passed through the intermediate compartment before flowing through the anode compartment of the cell. The conditions under which the cell operated were as shown in Table I.

TABLE I

| Current Density | Anolyte Acid Concentration (mean) | Catholyte pH (mean) | Coulombic Efficiency of Cobalt Deposition |
|---|---|---|---|
| 4000 A/m$^2$ | 133 gpl | 1.71 | 97% |
| 4000 A/m$^2$ | 147 gpl | 1.98 | 90% |
| 4000 A/m$^2$ | 172 gpl | 1.73 | 85% |

EXAMPLE 2

A cell as shown in FIG. 1 having a particulate cathode, was operated in a manner similar to that described above with reference to FIG. 1. As indicated in FIG. 1 water was added to the electrolyte circulating through the intermediate compartment. The overflow of acid from this circuit was added to the circuit flowing through the anode compartment. The overflow of acid from the anode compartment circuit was taken as product.

A number of experiments were carried out on a continuous basis. Both membranes were of the anionic type designated MA 3475 produced by the Ionac Chemical Company. The results obtained are given in Table II below.

TABLE II

| Membrane current density (A/M$^2$) | CATHOLYTE Cobalt concentration (gpl) | CATHOLYTE pH | Intermediate acid concentration (gpl $H_2SO_4$) | Anolyte acid concentration (gpl $H_2SO_4$) | Coulombic efficiency for Cobalt deposition (% of theoretical) |
|---|---|---|---|---|---|
| 4000 | 50 | 2.1 | 24 | 85 | 83 |
| 4000 | 52 | 1.6 | 38 | 112 | 75 |
| 4000 | 41 | 1.7 | 37 | 95 | 81 |
| 4000 | 30 | 2.0 | 27 | 91 | 82 |
| 4000 | 20 | 2.4 | 26 | 86 | 76 |

EXAMPLE 3

Similar experiments to the above were conducted but the membrane adjacent the cathode compartment was of the anion exchange type designated AMV from the Asahi Chemical Company and that adjacent the anode compartment was also of the anion exchange type but the type designated MA 3148 from the Ionac Chemical Company.

The results are given below in Table III.

TABLE III

| Membrane current density (A/M$^2$) | CATHOLYTE Cobalt concentration (gpl) | CATHOLYTE pH | Intermediate compartment acid concn. (gpl $H_2SO_4$) | Anolyte acid concentration (gpl $H_2SO_4$) | Coulombic efficiency for Cobalt deposition (% of theoretical) |
|---|---|---|---|---|---|
| 3000 | 43 | 1.8 | 44 | 91 | 91 |
| 4000 | 41 | 1.8 | 39 | 92 | 84 |
| 4000 | 33 | 2.0 | 50 | 108 | 81 |
| 4000 | 33 | 2.3 | 25 | 60 | 89 |
| 4000 | 33 | 2.3 | 22 | 60 | 93 |
| 4000 | 31 | 2.1 | 39 | 91 | 88 |
| 4000 | 28 | 2.6 | 27 | 62 | 92 |

While the invention has been illustrated by reference to the electrowinning of cobalt it is also particularly useful in the electrowinning of nickel and may find application with other metals, for example copper, manganese, zinc, iron, gold and silver.

We claim:

1. In a plant for the recovery of a metal from a material selected from the group consisting of ores, concentrates, mattes and alloys at a cathode of an electrolytic cell in an electrowinning circuit of said plant, the improvement which comprises an electrolytic cell having an anode compartment including an anode, a cathode compartment including a cathode, and an intermediate compartment interposed between the anode compartment and the cathode compartment, the boundaries between the anode compartment and the intermediate compartment and between the cathode compartment and the intermediate compartment, each including a separator which is permeable to at least one ionic species which, during operation of said cell, is present in at least one of the compartments bounded by the respective separators, the separator contiguous with the cathode compartment being permeable to anions; means for circulating catholyte around a first circuit which includes the cathode compartment; means for circulating anolyte around a second circuit which includes the anode compartment and which has no direct communication with said first circuit; means for circulating a solution around a third circuit including the intermediate compartment in which some of the circulated solution is transferred to one of said first and second circuits; and means for removing from one of said second and third circuits acid which is produced by operation of the electrolytic cell.

2. An electrolytic cell as claimed in claim 1, wherein the separator bounding the anode compartment is cation permeable, and the separator bounding the cathode compartment is anion permeable.

3. An electrolytic cell as claimed in claim 2, wherein the separator bounding the anode compartment is a cation exchange membrane, and the separator bounding the cathode compartment is an anion exchange membrane.

4. An electrolytic cell as claimed in claim 1, wherein the cathode compartment contains a particulate cathode.

5. An electrolytic cell as claimed in claim 3, wherein said first circuit comprises a catholyte tank to which metalliferous solution is fed, a conduit for supplying catholyte from said cathode compartment to said catholyte tank, a conduit including a pump for supplying catholyte from said catholyte tank to said cathode compartment, and means for conveying spent catholyte from said catholyte tank to an intermediate tank; wherein said third circuit comprises said intermediate tank, a conduit for supplying solution from the intermediate compartment to said intermediate tank, a conduit including a pump for supplying solution from said intermediate tank to said intermediate compartment, and means for removing spent catholyte containing product acid from said intermediate tank; and wherein said second circuit comprises an anolyte tank, a conduit for supplying anolyte from the anode compartment to the anolyte tank, and means including a pump for supplying anolyte from said anolyte tank to said anode compartment.

6. An electrolytic cell as claimed in claim 1, wherein (i) each of said separators in an anion exchange membrane; (ii) said first circuit comprises a catholyte tank to which metalliferous feed is added and from which spent catholyte is removed, a conduit for conveying catholyte from said cathode compartment to said catholyte tank, and a conduit including a pump for supplying catholyte from said catholyte tank to said cathode compartment; (iii) said second circuit comprises an anolyte tank, a conduit for supplying anolyte from said anode compartment to said anolyte tank, a conduit including a pump for supplying anolyte from said anolyte tank to said anode compartment, an outlet for product acid from said anolyte tank, and an inlet for dilute acid to said anolyte tank; and (iv) said third circuit comprises a dilute acid tank, a conduit for supplying solution from the intermediate compartment to said dilute acid tank, and conduit including a pump for supplying dilute acid from said dilute acid tank to said intermediate compartment, means for supplying water to said dilute said tank, and a conduit for transferring dilute acid from said dilute acid tank to said anolyte tank.

* * * * *